United States Patent [19]

Käding

[11] 4,136,527

[45] Jan. 30, 1979

[54] COOLING CONTINUOUSLY CAST INGOTS

[75] Inventor: Gert Käding, Krefeld, Fed. Rep. of Germany

[73] Assignee: Mannesmann Aktiengesellschaft, Dusseldorf, Fed. Rep. of Germany

[21] Appl. No.: 760,932

[22] Filed: Jan. 21, 1977

[30] Foreign Application Priority Data

Jan. 23, 1976 [DE] Fed. Rep. of Germany ..... 2602941

[51] Int. Cl.[2] ..... F25D 17/02

[52] U.S. Cl. ..... 62/64; 134/170; 134/181; 148/20.6; 164/89

[58] Field of Search ..... 62/64; 134/141, 170, 134/181, 199; 266/129, 214; 148/20.6; 164/89, 443, 444; 51/411

[56] References Cited

U.S. PATENT DOCUMENTS

| | | | |
|---|---|---|---|
| 2,287,825 | 6/1942 | Postlewaite | 62/64 |
| 3,228,146 | 1/1966 | Rosengarten, Jr. et al. | 51/411 |
| 3,545,460 | 12/1970 | Daum et al. | 134/181 |
| 3,693,352 | 9/1972 | Hinze et al. | 62/64 |
| 4,007,705 | 2/1977 | Sherer et al. | 51/411 |

*Primary Examiner*—Ronald C. Capossela
*Attorney, Agent, or Firm*—Smyth, Pavitt, Siegemund, Jones & Martella

[57] ABSTRACT

An ingot as descending from a mold for continuous casting is cooled by several revolving spray jets.

6 Claims, 3 Drawing Figures

12
S
2
8
2'
3'
9
2
10
1
4
5
3
13
6
2

3'
9
2a

COOLING CONTINUOUSLY CAST INGOTS

BACKGROUND OF THE INVENTION

The present invention relates to spray cooling a round ingot made by continuous casting.

Continous casting requires extensive cooling of the ingot as it is withdrawn and descends from the mold. It is a known practice to arrange spray nozzles annularly around the ingot and to discharge water through these nozzles, towards the ingot's surface. Other modes of distributing the nozzles are known, which is needed, for example, in case of slab ingots.

It was found that round ingots cannot be uniformly cooled in this fashion. The jet exiting from a nozzle ingot be approximated by a cone. That cone intersects the curved surface of the ingot. The rate of water inpacting on that surface per unit area differs around the ingot accordingly, so that cooling is non-uniform indeed. Inevitable, non-uniform cooling produces non-uniform skin thickness of the solidifying ingot, being still liquidous in its interior for quite a distance from the mold. Such non-uniformity inevitably increases the danger of skin rupture. This being the operation conditions, it is apparent that low withdrawal rates for ingots are required to ensure a wide margin of safety. The problem is compounded if, for any reason, a nozzle no longer functions as that introduces into the process a strong additional component as to non-uniformity. The nozzle has to be replaced or repaired immediately, but either procedure requires halting of the machine and of the casting process.

DESCRIPTION OF THE INVENTION

It is an object of the present invention to improve cooling of a round continuously cast ingot.

In accordance with the preferred embodiment of the invention, it is suggested to cool the ingot by means of one or several, radially inwardly directed revolving jets. The jet or jets thus produce one or several instantaneous cooling zones where impacting upon the ingot, and such a zone or zones inscribe one or several (intertwined) helical cooling tracks upon the ingot which should overlap. As a consequence, the ingot is quite uniformly cooled.

The jet or jets are preferably produced by one or several nozzles extending from a revolving ring-shaped, or annular chamber and being suitably driven for purposes of rotation. The annular chamber from which the nozzles extend, rotates in another chamber, and the nozzles extend through an annular slot in that other chamber while the latter has a fluid inlet communicating with the nozzle chamber through an annular slot of the latter.

The nozzle chamber is preferably constructed to serve in addition as turbine rotor for producing the rotation. Alternatively, the nozzle chamber may be self-propelled in that the nozzles and jets are being given a tangential component.

The invention arose from the need for improving the cooling of round ingots. However, the solution to the problem is also applicable to the cooling of ingots having cross-section of a regular polygon.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figures 1, 3:
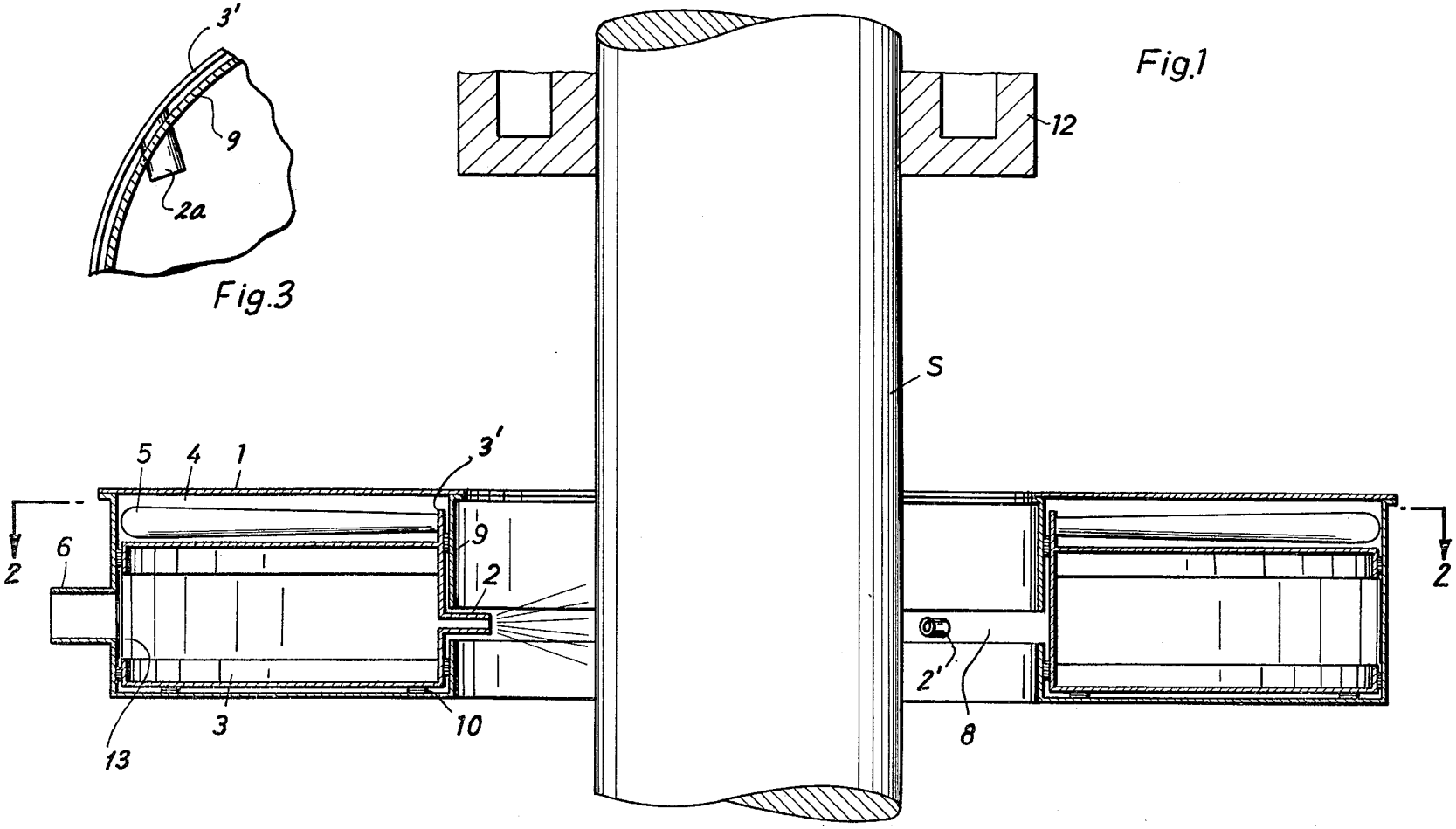
FIG. 1 is a cross-section through the bottom portion of a continuous casting machine and a top portion of a cooling facility constructed and improved in accordance with the preferred embodiment of the invention.
FIG. 3 illustrates a fragmentary view of a modification.
Figure 2:
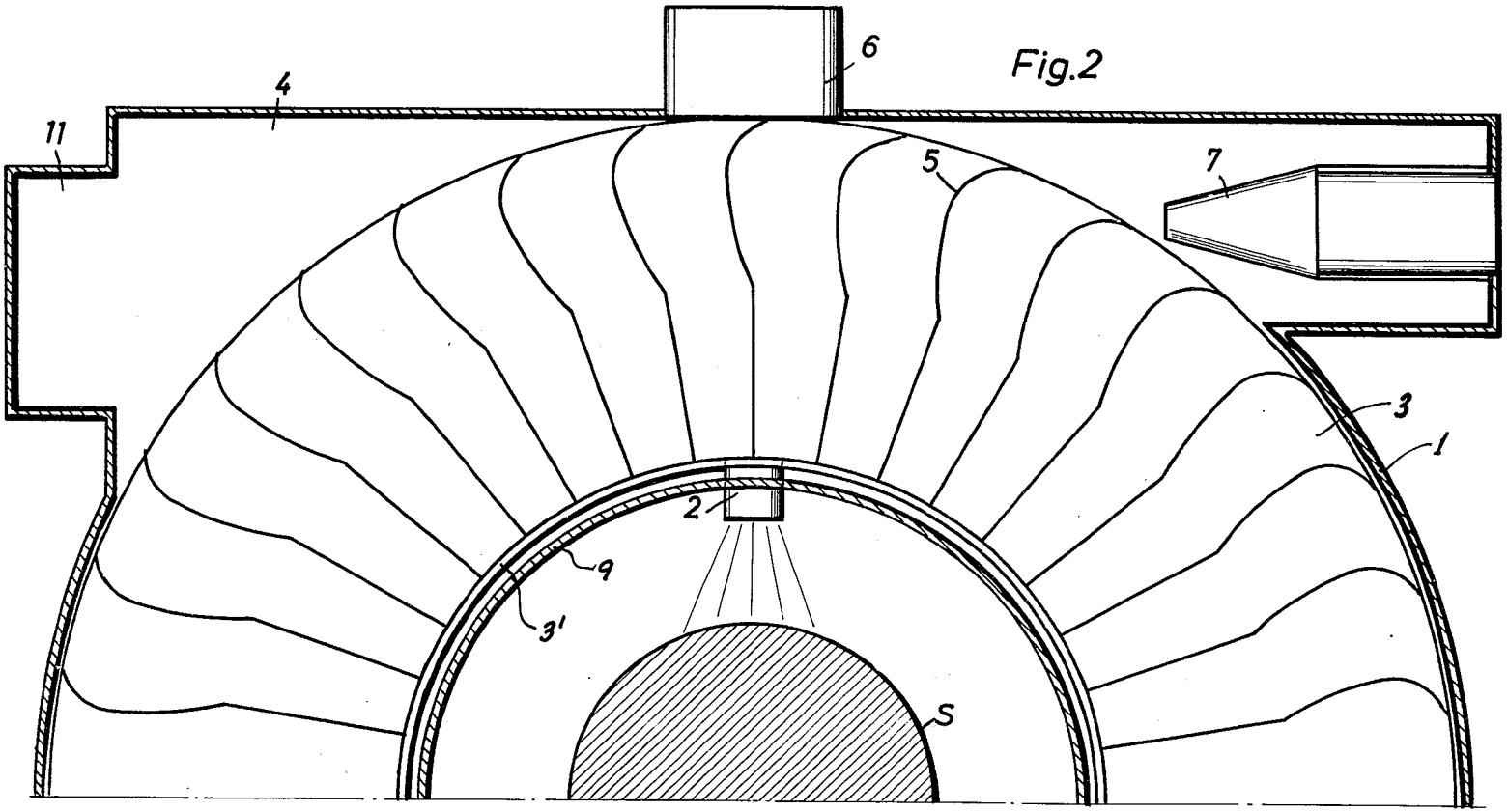
FIG. 2 is a fragmentary section view of the cooling facility shown in FIG. 1, taken along lines 1—1 in FIG. 1.

Proceeding now to the detailed description of the drawings, the Figures show a round, continuously cast ingot 5 leaving a mold 12 having internal cooling channels. The ingot passes centrally through an annulus or annular chamber 1, containing a rotatable annular pressure chamber 3, being provided with one or more nozzles 2, 2', etc. It was found that three regularly spaced (i.e. 120 inches apart) nozzles give best results.

The annular, outer chamber 1 of the chamber assembly 1, 2 has an annular slot 8 on its radial inside wall 9, and nozzles 2, 2' extend through that slot. Nozzle chamber 3 has an annular slot 13 along its radial outside wall so that an inlet 6 of chamber 1 can communicate with chamber 3 regargless of the position of the latter. Thus, pressurized fluid, e.g., cooling water can be continuously fed into chamber 3 for discharge therefrom as radially inwardly directed cooling jets produced by nozzles 2, 2', etc.

The pressure chamber 3 is not as high as chamber 1, so that an annnular chamber 4 is defined between top wall for chamber 3 and the top wall for chamber 1. This annular space 4 serves as a turbine chamber. Turbine blade-like wings 5 are mounted to chamber 3, extending radially outwardly from an axial, upward extension 3' of the inner wall of chamber 3.

The turbine chamber 4 has a tangential feeder inlet occupied by a pressure nozzle 7. Chamber 4 is also provided with an outlet 11, being disposed in the same level as nozzle 7, for discharge of the pressure medium that is discharged by nozzle 7 into chamber 4. Conceivably, one will use also water as propellant to drive the turbine.

Reference numeral 10 refers to slide support elements for mounting the chamber 3 for rotation in chamber 1. These elements 10 may be plastic disks, washers, or the like, being affixed either to walls of chamber 3 or to walls of chamber 1. They may also serve as seals, though in the case of using the same fluid medium, sealing is required only to the extent of separating the two pressure inlets 6 and 7, if different pressures are maintained in chambers 3 and 4.

It can thus be seen that upon discharging pressurized fluid through nozzle 7 the turbine is set into motion causing chamber 3 with its nozzle to rotate. The nozzles 2, 2', etc., thus blow coolant jets against the ingot S along a helical path as to each jet. The cooling is necessarily a uniform one if the ingot S descends at a constant speed and if the turbine rotates also at a constant speed. The relationship between turbine speed and ingot descent determines the pitch of the helix. Actually, the three nozzles each set up a cooling zone on the surface of the ingot as it is effective in any instant, annd these cooling zones migrate on account of the rotation, resulting in helical zones of cooling. These zones should overlap, possibly significantly by operation of a rather tight spiral path of each zone.

Ingot descent and nozzle speed can be varied independently if deemmed necessary. The rate of water disharge through nozzles 2, i.e. the pressure of coolant as fed, is another parameter that can be selected. Therefore, the cooling action is readily adaptable to particular, even to changing conditions.

One should use several nozzles in order to have at least one "spare" one available. If one nozzle drops out, cooling is still not non-uniform, particularly if the rate of coolant flow is maintained constant.

As shown in FIG. 3, the turbine construction can be omitted if the nozzles impart a tangential component upon the ejected jet. This way, the nozzle chamber 3 becomes self-propelled. However, independent propelling is preferred as in the case of self-propelling, water flow rate, and rotational speed of chamber 3, are intimately tied together.

The invention is not limited to the embodiments described above but all changes and modifications thereof not constituting departures from the spirit and scope of the invention are intended to be included.

I claim:

1. Method of cooling a continuously cast ingot as the ingot descends from a mold at a particular speed, the ingot having a surface, comprising the step of spraying water towards the surface of the ingot by means of a radially inwardly directed jet, and causing the jet to revolve about the central axis of the ingot at a particular speed to vary the direction of spraying in relation to the surface of the ingot.

2. Method as in claim 1 and including the step of varying the revolving speed of the jet.

3. Method as in claim 1, wherein the speed of revolution is adjusted in relation to the speed of ingto descent so that the areas cooled sequentially overlap.

4. Method as in claim 1 wherein in addition to said revolving the ingot is cooled by additionally spraying water in at least one additional revolving jet.

5. Method as in claim 1, wherein the jet has a tangential component in relation to a circle on which the jet revolves thereby causing the jet to revolve.

6. Method as in claim 1 wherein the jet is caused to revolve independently from a generation of the jet.

* * * * *